US010299027B2

(12) United States Patent
Olsson

(10) Patent No.: US 10,299,027 B2
(45) Date of Patent: May 21, 2019

(54) HEADSET WITH REDUCTION OF AMBIENT NOISE

(71) Applicant: GN Audio A/S, Ballerup (DK)

(72) Inventor: Rasmus Kongsgaard Olsson, Ballerup (DK)

(73) Assignee: GN Audio A/S (DK)

( * ) Notice: Subject to any disclaimer, the term of this patent is extended or adjusted under 35 U.S.C. 154(b) by 0 days.

(21) Appl. No.: 16/027,809

(22) Filed: Jul. 5, 2018

(65) Prior Publication Data

US 2019/0014404 A1 Jan. 10, 2019

(30) Foreign Application Priority Data

Jul. 6, 2017 (EP) ..... 17180007

(51) Int. Cl.
*H04R 1/10* (2006.01)
*G10L 25/78* (2013.01)

(52) U.S. Cl.
CPC ..... *H04R 1/1083* (2013.01); *G10L 25/78* (2013.01); *G10L 2025/783* (2013.01); *H04R 1/1008* (2013.01)

(58) Field of Classification Search
CPC ..... H04R 1/10; H04R 3/005; G10L 25/78
USPC ..... 381/74, 92, 110; 704/233, 214
See application file for complete search history.

(56) References Cited

U.S. PATENT DOCUMENTS 5,619,566 A 4/1997 Fogel
8,682,250 B2 3/2014 Magrath et al.
8,824,666 B2 9/2014 Conte et al.
9,438,985 B2 9/2016 Dusan et al.
2007/0165834 A1 7/2007 Redman et al.
2007/0189547 A1 8/2007 Hsu et al.
2008/0317259 A1* 12/2008 Zhang ..... G10L 15/04 381/92
2009/0323925 A1 12/2009 Sweeney et al.
2014/0372113 A1* 12/2014 Burnett ..... G10L 21/0208 704/233

FOREIGN PATENT DOCUMENTS

CN 106448691 2/2017
EP 0969692 1/2000
EP 1602223 12/2005
(Continued)

OTHER PUBLICATIONS

Extended European Search Report for European patent application No. 17180007.1 dated Sep. 20, 2017.

*Primary Examiner* — Melur Ramakrishnaiah
(74) *Attorney, Agent, or Firm* — Altera Law Group, LLC

(57) ABSTRACT

A headset with an electro-acoustic input transducer arranged to pick up an acoustic signal and convert the acoustic signal to an electric signal. Based on processing a portion of the electric signal, the voice activity detector is configured to: detect proximal voice activity, distal voice activity and no voice activity, at times when respectively present in the acoustic signal picked up by the electro-acoustic transducer, and to select a respective mode, the selection of which is encoded in the control signal. The first processor is controlled by the voice activity detector to reduce, in the output signal, intelligibility of distal voice activity at least at portions of time periods when the control signal indicates the mode of presence of distal voice activity.

16 Claims, 4 Drawing Sheets

(56) References Cited

FOREIGN PATENT DOCUMENTS

| | | |
|---|---|---|
| WO | WO 2004/082249 | 9/2004 |
| WO | WO 2007/057879 | 5/2007 |
| WO | WO 2008/082793 | 7/2008 |

* cited by examiner

HEADSET WITH REDUCTION OF AMBIENT NOISE

Headsets may serve different functions—one of them being as a telephone receiver, wherein a user who is a near-end party to a call wears the headset to capture her voice and transmit it to one or more persons who are far-end parties to the call and to receive and reproduce the voice of one or more far-end persons as an acoustic signal.

Headsets are used in various situations and oftentimes when the user of the headset is at a location where other people have conversations, such as loud conversations, in the vicinity. This may be the situation in an office or at other locations e.g. in a call-centre.

In connection therewith it is experienced that users of headsets report the problem that the far-end persons can hear and sometimes understand what is being said by people who are in the vicinity of the person wearing the headset. Thus, the headset microphone captures not only the voice of the user of the headset, but also the voice of people talking in the vicinity of the user. This problem is especially pronounced when conversations taking place on a call should be confidential.

RELATED PRIOR ART

U.S. Pat. No. 8,824,666 (Empire Technology Development) describes a headset with a noise cancellation unit, that receives a microphone signal from a microphone at the headset and another microphone signal from a microphone at a mobile phone connected to the headset. Thus, the microphone of the mobile phone is used as a secondary microphone for suppressing ambient noise. There is thus provided a phone noise cancellation system for reducing noise associated with a mobile phone conversation, thereby reducing nuisance to others and increasing privacy for the mobile phone user.

U.S. Pat. No. 9,438,985 (Apple) describes a method of detecting a user's voice activity at a headset with an array of microphones. The method starts with a voice activity detector (VAD) generating a VAD output based on acoustic signals received from microphones included in a pair of earbuds and the microphone array included on a headset wire and data output by an accelerometer that is included in the pair of earbuds. A noise suppressor may then receive the acoustic signals from the microphone array and the VAD output and suppress the noise included in the acoustic signals received from the microphone array based on the VAD output. The method may also include steering one or more beamformers based on the VAD output.

U.S. Pat. No. 8,682,250 (Wolfson Microelectronics) describes a noise cancellation system for an audio system such as a mobile phone handset, or a wireless phone headset which has a first input for receiving a first audio signal from one or more microphone positioned to receive ambient noise, and a second input for receiving a second audio signal from a microphone positioned to detect the user's speech, as well as a third input for receiving a third audio signal for example representing the speech of a person to whom the user is talking. A first noise cancellation block receives the first audio signal and generates a first noise cancellation signal, and this is combined with the third audio signal to form a first audio output signal. A second noise cancellation block receives at least a part of the first audio signal and said second audio signal and applying noise cancellation to generate a second audio output signal.

The above prior art documents describe different ambient noise suppression methods, however all of them being based on hardware configurations with multiple microphones for picking up microphone signals at different locations.

Conventional, non-directional, noise suppression methods fails to appropriately suppress ambient noise e.g. in the form of (interfering) speech from persons in vicinity of the wearer of the headset.

More particularly, the above prior art fails to suggest an ambient noise suppression method based on hardware with availability of a single microphone, while being capable of suppressing noise in the form of speech occurring in the vicinity of the headset user. This problem remains unsolved in the above-mentioned prior art.

SUMMARY

It is an object to provide a headset which communicates a signal representing a wearer's speech, while speech from persons in vicinity of the wearer is less likely to be intelligible when the signal is reproduced as an acoustic signal. By being less likely to be intelligible may be understood that the speech from one or more persons in vicinity of the wearer is made more difficult to hear and/or understand.

It is an object, in connection with generating the signal to be communicated from the headset, to provide a headset with noise suppression that represents a trade-off between, on the one hand, preserving and/or improving the intelligibility and/or quality of the wearer's speech while, on the other hand, actively reducing intelligibility speech from persons in vicinity of the wearer.

It is an additional object to provide a headset with noise suppression that complies with the above objects while the headset includes a single microphone or is void of beamforming means receiving signals from multiple microphones at the headset.

It is an object to provide a headset which complies with the above trade-off while keeping a low processing latency.

There is provided a headset comprising:

an electro-acoustic input transducer arranged to pick up an acoustic signal and convert the acoustic signal to an electric signal;

a transmitter;

a voice activity detector; and a first processor coupled to receive the electric signal and to generate an output signal to the transmitter in response to a control signal from the voice activity detector;

wherein, based on processing a portion of the electric signal, the voice activity detector is configured to: detect proximal voice activity, distal voice activity and no voice activity, at times when respectively present in the acoustic signal picked up by the electro-acoustic transducer, and to select a respective mode, the selection of which is indicated in the control signal; and wherein the first processor is controlled by the voice activity detector to reduce, in the output signal, intelligibility of distal voice activity at least at portions of time periods when the control signal indicates the mode of presence of distal voice activity.

Thus, the headset detects proximal voice activity, distal voice activity and no voice activity, at times when respectively present in the acoustic signal picked up by the electro-acoustic transducer. In response to being detected, the voice activity detector selects a respective mode, e.g. by means of a state machine, and communicates the respective mode to the first processor which is configured, e.g. by programming, to reduce, in the output signal, intelligibility of distal voice activity at least at portions of time periods when the control signal indicates of the mode presence of distal voice activity.

In some aspects the voice activity detector is configured to: instantaneously detect proximal voice activity, distal voice activity and no voice activity, at times when respectively present in the acoustic signal picked up by the electro-acoustic transducer, while a respective mode is selected based on one or more timing criteria to actively reduce transitions, from one state to another and back again. Thereby artefacts in the output signal resulting from such transitions are reduced. By instantaneously is understood within less than a second, e.g. within 10 milliseconds. Transitions, from one state to another and back again, may be actively prevented from occurring too fast or too often, despite faster instantaneous detections, e.g. by a state machine. Transitions may be prevented from occurring more than once per 1 to 5 seconds, e.g. prevented from occurring more than once per 3 seconds. More details are given further below.

In some aspects the voice activity detector is configured to detect the electric signal as being related to one or more of 'proximal voice activity', 'distal voice activity' and 'no voice activity' on an ongoing or running basis. The detection may be based on classifying the electric signal on an ongoing or running basis. The respective mode is selected based on the detection e.g. in response to timing criteria.

The first processor is additionally configured, as it is conventionally known, to perform one or more of conventional functions of: equalisation to compensate for e.g. an undesired frequency response of the electro-acoustic input transducer; signal compression; filtering, e.g. high-pass filtering to suppress infrasound; automatic gain control, AGC; echo control e.g. comprising echo cancelling and echo suppression. The first processor may additionally perform other types of signal processing in providing the output signal. The first processor may forgo performing one or more, such as all, of these conventional functions when some modes are selected, e.g. when a mode corresponding to a failure to detect 'proximal voice activity' is selected; which may be the case when a mode corresponding to 'distal voice activity' or 'no voice activity' is detected.

The electro-acoustic input transducer may be a microphone, e.g. of the capacitive type, outputting an analogue signal or a digital signal. The electro-acoustic input transducer may be arranged on e.g. a so-called microphone boom of the headset or on an ear-cup thereof. The headset may comprise a single electro-acoustic input transducer.

The control signal from the voice activity detector to the first processor may be a so-called single-wire or multi-wire control signal. The selected mode may be indicated on separate lines or be encoded in the control signal. It is known in the art to communicate control signals to indicate selection of one or more states among multiple states.

The transmitter may comprise circuitry, as it is known in the art, for appropriately providing the output signal by one or more of: an analogue amplifier, buffer or driver for supplying the output signal on a wired connection; by a digital codec providing the output signal as a digital output signal in accordance with an appropriate protocol; a wireless transmitter e.g. in accordance with a Bluetooth® standard, a DECT standard, or a Wi-Fi standard. The transmitter may be combined with a receiver, receiving a signal from a far-end, e.g. to form an integrated transceiver.

In some aspects the voice activity detector and the first processor are configured as one or more digital signal processors operating in the digital domain. In connection therewith, as it is known in the art, the headset comprises an analogue-to-digital converter, which may be comprised by a microphone housing or comprised by an integrated circuit, such as an integrated circuit comprising the voice activity detector and the first processor. In connection therewith digital signal processing may be based on a combination of a time domain representation and a frequency domain representation of the electric signal, the latter being obtained e.g. by a Fast Fourier Transformation, FFT, as it is known in the art. In connection therewith an Inverse Fast Fourier Transformation, IFFT, may be used as it is known in the art.

The first processor may comprise a digital filter, such as a FIR or IIR filter or a combination thereof, which is controlled by the voice activity detector to reduce, in the output signal, intelligibility of distal voice activity at least at portions of time periods when the control signal indicates of the mode presence of distal voice activity by performing respective filtering.

In some embodiments the first processor is configured to reduce intelligibility of distal voice activity by performing one or more of: suppression, such as amplitude suppression, filtering, scrambling, and camouflaging of signal components in the electrical signal.

Thereby reduced intelligibility of speech from persons in vicinity of the wearer of the headset is provided. Suppression may comprise frequency dependent suppression (narrow band suppression) or squelch type suppression (broad band). Scrambling and camouflaging may add signal components to the output signal or distort the output signal to thereby reduce intelligibility of speech.

In some aspects the first processor is configured to reduce intelligibility of distal voice activity at times while the voice activity detector keeps a respective mode, selected based on detection of distal voice activity, selected.

In some embodiments the voice activity detector detects proximal voice activity based on a first criterion based on a detection of the electric signal having a loudness and/or signal-to-noise ratio above a first threshold.

Thereby any sufficiently loud or clear electric signal may result in detection of proximal voice activity. Such detection may be instantaneous and secure that the wearer's speech is appropriately detected for the purpose of processing the speech at the first processor without degrading intelligibility and/or quality thereof when communicating the wearer's speech to a far-end. By loudness is understood amplitude, or power, of the signal or an instantaneous magnitude the signal.

The signal-to-noise ratio may be determined for each of multiple frequency bins (narrow band) or across multiple frequency bins (broad band).

The first threshold may be a scalar value or an array of values. The first threshold may be determined from experiments and/or via an adaptive algorithm.

In some aspects the first criterion is further based on a detection of the electric signal having harmonic components qualifying the electric signal as comprising speech. Such detection is known in the art, e.g. in the art of speech recognition.

The detection may be based on time limited segments provided in sequence as a digital signal.

In some embodiments the voice activity detector detects distal voice activity based on a second criterion based on a detection of the electric signal having a loudness and/or signal-to-noise ratio failing to exceed a second threshold while having signal components qualifying the electric signal as comprising speech.

Thereby when the electric signal fails to be sufficiently loud or clear, while it is determined to qualify as speech, detection of distal voice activity provided. Thereby distal voice activity may be distinguished over ambient noise not relating to speech and over the wearer's speech. Typically, the electro-acoustic input transducer is located within a few centimeters, e.g. up to 10 to 15 centimeters, from the wearer's mouth (when the headset is worn in normal way), whereas people in vicinity of the wearer may be at a distance of more than half a meter. Thus, the wearer's speech is in general louder and/or clearer than speech from persons in the vicinity. The second threshold may be determined from experiments and/or via an adaptive algorithm.

In some embodiments the voice activity detector detects no voice activity, based on a third criterion, based on a detection of the portion of the electric signal having a loudness and/or signal-to-noise ratio failing to exceed a third threshold. Thereby ambient noise can be reliably detected, which in turn enables respecting the above-mentioned trade-offs.

In some aspects, the third criterion additionally comprises detecting that the electric signal fails to have signal components qualifying the electric signal as comprising speech. As a part of determining whether signal components qualifies the electric signal to comprise speech it may be determined that harmonic signal components fails to have an amplitude exceeding a predefined threshold.

In connection with the above-mentioned first, second and third criterion it is noted that the criteria may be implemented by programming a programmable processor comprising the voice activity detector. A person skilled in the art is capable of implementing such criteria.

In connection with the above-mentioned first, second and third threshold it is noted that the first threshold may be set at a higher level than both the first and second threshold. The second threshold may be lower than the first threshold and higher than the third threshold. The third threshold may be lower than the first and second threshold. Alternatively, the third threshold may be lower than the first threshold, but higher than the second threshold.

In some embodiments the first processor is configured with a noise reduction filter, which is operative to perform noise reduction at least at times when the control signal is indicative of a mode corresponding to presence of proximal voice activity.

The noise reduction filter may perform frequency bin selective noise suppression whereby signal component of the electric signal is reduced or modified relative to each other to suppress frequency bins representing noise relative to frequency bins representing speech. Thereby a broad band signal-to-noise ratio is improved. Such noise reduction methods are known in the art. It is advantageous to perform noise reduction at times when proximal voice activity is detected to be applied. The noise reduction may however be shifted to a more aggressive noise reduction at times when distal voice activity, which is different from proximal voice activity, is detected.

In some embodiments the first processor is configured with a first filter, which is a squelch filter or a noise reduction filter, which is operative to perform first signal suppression at least at times when the control signal is indicative of no voice activity; and the first processor is configured with a second filter, which is a squelch filter or a noise suppression filter, which is operative to perform second signal suppression at least at times when the control signal is indicative distal voice activity.

Thereby filtering of the electric signal can be specifically adapted to more effectively suppress the respective type of noise being detected as either no voice activity or distal voice activity. This is performed by the voice activity detector supplying the control signal indicative of a corresponding mode to the first processor.

As noted above, the noise reduction filter performs frequency bin selective noise suppression (narrow band). The squelch filter suppresses noise across all or a majority of frequency bins (broad band) by substantially uniform noise suppression factors.

By 'no voice activity' may be understood that the voice activity detector fails to detect proximal voice activity and fails to detect distal voice activity.

By 'being configured with a filter' is meant that a signal processor may be configured e.g. with a filter implemented by programming. The filter may be enabled and disabled at different times.

In some embodiments the second signal suppression is significantly greater than the first signal suppression. This is an effective signal processing strategy of the headset since the distal voice activity may be perceived as more disturbing (by a far-end party) than ambient noise, not qualifying as being speech. This is also the case since greater signal suppression may come at the cost of involving other problems e.g. related to so-called 'late release' whereby intelligibility and/or quality of proximal voice activity, especially at the times when proximal voice activity commences may be reduced since the greater signal suppression persists despite proximal voice activity has commenced. Thus, when the second signal suppression is greater than the first signal suppression, the risk of reducing intelligibility and/or quality of proximal voice activity can be reduced at least in some situations e.g. following periods where ambient, non-speech, noise was detected i.e. following periods of 'no voice activity'.

The second signal suppression may be e.g. 50 dB and the first signal suppression may be e.g. 10 dB. Thereby, the second signal suppression is greater by 40 dB. The first and second signal suppression may represent an average or median value across multiple, such as all, frequency bins.

In some embodiments the first signal processor is configured to perform the first signal suppression in the range between 6 dB and 18 dB and to perform the second signal suppression at more than 24 dB, such as at more than 30 dB, such as at more than 40 dB.

The second signal suppression may be in the range of 18 dB to 60 dB, e.g 50 dB. Thereby the second signal suppression is made significantly more aggressive than the first signal suppression, which enables significant improvements over conventional single-microphone headsets in reducing intelligibility (at the far-end) of speech in the vicinity of the headset wearer.

By suppression in the range between 6 dB and 18 dB is understood that the gain is in the range of −6 dB to −18 dB. Thus the 'minus' represents suppression. This applies throughout this specification.

In some embodiments the headset comprises a delay coupled to delay the electric signal at a signal processing stage before the filtering to reduce intelligibility of distal voice activity; wherein the delay is controllable via a delay control signal to delay the electric signal by a first delay time or to forgo delay of the electric signal by the first delay time; wherein the voice activity detector is configured to detect proximal voice activity, distal voice activity and no voice activity based on the electric signal before the delay;

wherein the voice activity detector generates the delay control signal to delay the electric signal by the first delay time at times when the control signal indicates selection of a mode corresponding to presence of distal voice activity, and to forgo delaying of the electric signal by the first delay time at times when the control signal is indicative of failure to detect presence of proximal voice activity.

Thereby it is possible to avoid problems e.g. related to 'late releases' whereby cutting off or otherwise reducing intelligibility of proximal voice activity is at risk of occurring, especially at the times when proximal voice activity commences. Especially, it is thereby possible to more aggressively suppress distal voice activity, which may be more disturbing (to a far-end) than other types of ambient noise.

Since the voice activity detector is configured to detect proximal voice activity, distal voice activity and no voice activity based on the electric signal before the delay, look-ahead for detecting proximal voice activity is provided.

The first delay time may be in the range of 20 to 100 milliseconds, e.g. in the range of 40 to 80 milliseconds, e.g. in the range of 40 to 60 milliseconds. This amount of delay time is considered to not reduce the naturalness of a conversation, since it is a relatively short delay compared to the latency experienced during e.g. a telephone conversation. However, it is preferred to forgo delay of the electric signal by the first delay time; which is provided by forgoing delaying of the electric signal by the first delay time at times when the control signal (PDN) is indicative of presence of proximal voice activity.

Since the voice activity detector is configured to detect proximal voice activity, distal voice activity and no voice activity based on the electric signal before the delay it is possible to instantaneously detect which mode to select. However, the selection of mode for controlling the first processor may be subject timing criteria whereby transitioning between modes is limited compared to how often instantaneously detect takes place. This is explained in more detail further below.

In some embodiments the voice activity detector is configured to delay the electric signal by the first delay time in response to detection of continued detection of distal voice activity over a first period of time.

The first period of time may be in the range of 1 to 5 seconds, e.g. 1 to 3 seconds. Such a first period of time is sufficient to reduce the risk of the speech being proximal speech commencing.

In some aspects the detection of continued detection of distal voice activity over a first period of time causes the signal processor to change its signal processing from the first signal suppression in the range between 6 dB and 18 dB to perform the second signal suppression at more than 24 dB, such as at more than 30 dB, such as at more than 40 dB.

The detection of continued detection of distal voice activity over a first period of time may be performed by the voice activity detector configured as a state machine.

In some embodiments the voice activity detector is configured to forgo delaying the electric signal by the first delay time in response to detection of continued failure to detect distal voice activity and/or in response to continued detection of proximal voice activity over a second period of time.

The first period of time may be in the range of 5 to 30 seconds, e.g. about 10 to 20 seconds. Such a second period of time is sufficient to reduce the risk of audible artefacts being perceived when the first signal processor alters between different noise suppression levels as described above.

In some embodiments the headset comprises a noise generator for adding digitally generated noise to the output signal. Digitally generated noise may comprise one or more of pseudo random noise, sampled office noise, coloured noise, and white noise. The digitally generated noise may be added at times when the control signal is indicative of a mode corresponding to distant voice activity.

There is also provided a method, at a headset with an electro-acoustic input transducer arranged to pick up an acoustic signal and convert the acoustic signal to an electric signal, a first processor coupled to receive the electric signal and to generate an output signal to the transmitter in response to a control signal from the voice activity detector, and a transmitter; the method comprising:

detecting proximal voice activity, distal voice activity and no voice activity, based on processing a portion of the electric signal, at times when respectively present in the acoustic signal picked up by the electro-acoustic transducer;

selecting a respective mode, the selection of which is encoded in the control signal; and reducing, in the output signal, intelligibility of distal voice activity at least at portions of time periods when the control signal indicates the mode of presence of distal voice activity.

The method may also or alternatively be performed by a base station for a headset.

There is also provided a computer-readable medium encoded with instructions to make a processor at a headset perform the method when executed by the processor.

Here and in the following, the terms 'unit', 'processor', and 'voice activity detector' are intended to comprise any circuit and/or device suitably adapted to perform the functions described herein. In particular, the above term comprises general purpose or proprietary programmable microprocessors, Digital Signal Processors (DSP), Application Specific Integrated Circuits (ASIC), Programmable Logic Arrays (PLA), Field Programmable Gate Arrays (FPGA), special purpose electronic circuits, etc., or a combination thereof.

Broadly speaking, there is a disclosed in this document, a headset having any or all of the following elements:

an electro-acoustic input transducer arranged to pick up an acoustic signal and convert the acoustic signal to an electric signal (x);

a transmitter;

a voice activity detector;

a first processor coupled to receive the electric signal (x) and to generate an output signal (y) to the transmitter in response to a control signal (PDN) from the voice activity detector;

wherein, based on processing a portion of the electric signal (x), the voice activity detector is configured to: detect proximal voice activity, distal voice activity and no voice activity, at times when respectively present in the acoustic signal picked up by the electro-acoustic transducer, and to select a respective mode, the selection of which is indicated in the control signal (PDN);

wherein the first processor is controlled by the voice activity detector to reduce, by filtering, in the output signal, intelligibility of distal voice activity at least at portions of time periods when the control signal (PDN) indicates the mode of presence of distal voice activity;

a delay coupled to delay the electric signal at a signal processing stage before the filtering to reduce intelligibility of distal voice activity;

wherein the delay is controllable via a delay control signal (DL) to delay the electric signal by a first delay time or to forgo delay of the electric signal by the first delay time;

wherein the voice activity detector is configured to detect proximal voice activity, distal voice activity and no voice activity based on the electric signal before the delay; and wherein the voice activity detector generates the delay control signal (DL) to delay the electric signal by the first delay time at times when the control signal indicates selection of a mode corresponding to presence of distal voice activity, and to forgo delaying of the electric signal by the first delay time at times when the control signal (PDN) is indicative of failure to detect presence of proximal voice activity.

Also disclosed is a headset wherein the first processor is configured to reduce intelligibility of distal voice activity by performing one or more of: suppression, such as amplitude suppression, scrambling, and camouflaging of signal components in the electrical signal.

Also disclosed is a headset wherein the voice activity detector detects proximal voice activity based on a first criterion based on a detection of the electric signal (x) having a loudness and/or signal-to-noise ratio above a first threshold.

Also disclosed is a headset wherein the voice activity detector detects distal voice activity based on a second criterion based on a detection of the electric signal (x) having a loudness and/or signal-to-noise ratio failing to exceed a second threshold while having signal components qualifying the electric signal as comprising speech.

Also disclosed is a headset wherein the voice activity detector detects no voice activity, based on a third criterion, based on a detection of the portion of the electric signal (x) having a loudness and/or signal-to-noise ratio failing to exceed a third threshold.

Also disclosed is a headset wherein the first processor is configured with a noise reduction filter, which is operative to perform noise reduction at least at times when the control signal is indicative of a mode corresponding to presence of proximal voice activity.

Also disclosed is a headset wherein the first processor is configured with a first filter, which is a squelch filter or a noise reduction filter, which is operative to perform first signal suppression at least at times when the control signal (PDN) is indicative of no voice activity; and wherein the first processor is configured with a second filter, which is a squelch filter or a noise suppression filter, which is operative to perform second signal suppression at least at times when the control signal is indicative distal voice activity.

Also disclosed is a headset wherein the second signal suppression is significantly greater than the first signal suppression.

Also disclosed is a headset wherein the first signal processor is configured to perform the first signal suppression in the range between 6 dB and 18 dB and to perform the second signal suppression at more than 24 dB, such as at more than 30 dB, such as at more than 40 dB.

Also disclosed is a headset wherein the voice activity detector is configured to delay the electric signal by the first delay time in response to detection of continued detection of distal voice activity over a first period of time.

Also disclosed is a headset wherein the voice activity detector is configured to forgo delaying the electric signal by the first delay time in response to detection of continued failure to detect distal voice activity and/or in response to continued detection of proximal voice activity over a second period of time.

Also disclosed is a headset wherein a noise generator adds digitally generated noise to the output signal.

Also disclosed is a method, at a headset with an electro-acoustic input transducer arranged to pick up an acoustic signal and convert the acoustic signal to an electric signal (x), a first processor coupled to receive the electric signal (x) and to generate an output signal (y) to the transmitter in response to a control signal (PDN) from the voice activity detector, and a transmitter having any or all of the following steps in any order:

detecting proximal voice activity, distal voice activity and no voice activity, based on processing a portion of the electric signal (x), at times when respectively present in the acoustic signal picked up by the electro-acoustic transducer;

selecting a respective mode (PVA, DVA, NVA), the selection of which is encoded in the control signal (PDN); and reducing, in the output signal, intelligibility of distal voice activity at least at portions of time periods when the control signal indicates the mode of presence of distal voice activity.

Also disclosed is a headset with a computer-readable medium encoded with instructions to make a processor at a headset perform the method above.

BRIEF DESCRIPTION OF THE FIGURES

A more detailed description follows below with reference to the drawing, in which.

DETAILED DESCRIPTION

Figure 1:
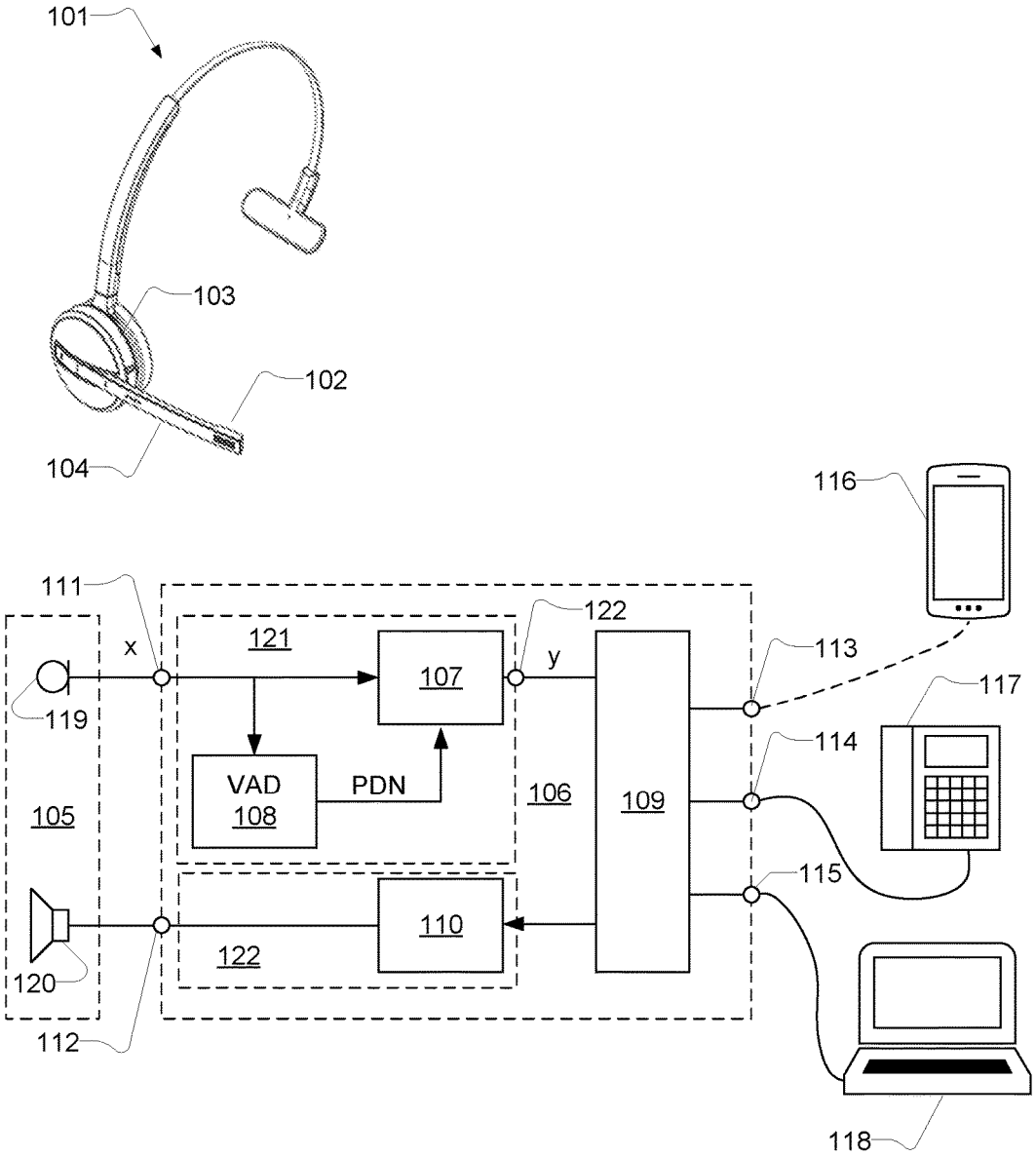
FIG. 1 shows a headset in a perspective view and a block diagram for a headset with a processor.

FIG. 1 shows a headset in a perspective view and a block diagram for a headset with a processor. As shown in the perspective view, the headset 101 may have a housing 103 with an ear-cup, of the on-the-ear type or over-the-ear type and a microphone boom 104 extending from the housing 103 and having a microphone end or microphone compartment 102 hosting a microphone, for picking up a headset wearer's speech. The microphone is designated reference numeral 119 in the below block diagram. Inevitably the microphone 119 will pick up not only the wearer's speech, but also ambient noise such as speech from people in vicinity of the wearer of the headset 101. The microphone may be a single microphone in the sense that it is the only one active microphone at a time. Thereby electronic beamforming is not an option. The microphone may however be configured with a physical design giving the microphone some directivity.

A headband or head support is provided for holding the headset on the headset wearer's head. In some embodiments, the headset 101 may have an additional ear-cup for the other ear. In some embodiments the ear-cups are of the earbud type and the microphone boom 104 is replaced by an in-line microphone which is attached to a cord. The cord may connect to the headset to a computer 118, a desk telephone 117, or a smartphone 116—in some embodiments via a base-station for the headset (not shown). In some embodiments the headset is a wireless headset communicating wirelessly with one or more of the computer 118, the desk telephone 117, the smartphone 116 or the base station.

As shown in the block diagram, the headset 101 (represented by the dashed-line boxes) comprises a loudspeaker 119 and a microphone 120. Further circuitry such as a preamplifier and an analogue-to-digital converter for the microphone is not shown.

The headset 101 has an electronic circuit 106, which may be accommodated in the housing 103. The signal processor 106 is configured with a microphone terminal 111 for receiving a microphone signal from the microphone 119, a loudspeaker terminal 112 for outputting a loudspeaker signal to the loudspeaker 120, and a far-end port 113;114;115 for communicating an inbound signal and an outbound signal with a far-end such and via radio circuit (not shown).

Here and in the following, a far-end refers to a communications device, audio receiver or system to which the headset wearer's speech, as reproduced by the microphone 120 and an outbound path 121 of the headset, is transmitted as an outbound signal and/or a communications device, audio source or system from which an audio signal is received as an inbound signal via an inbound path 122 and reproduced in the loudspeaker 120 towards the headset wearer's ear. The inbound path 122 may comprise one or more of an amplifier and a digital-to-analogue converter generally designated 110. An inbound signal and an outbound signal refer to any type of audio signal received from and transmitted to the far end, respectively.

The electronic circuit 106 is also configured with a transmitter 109 which may comprise circuitry, as it is known in the art, for appropriately providing the output signal by one or more of: an analogue amplifier, buffer or driver for supplying the output signal on a wired connection; by a digital codec providing the output signal as a digital output signal in accordance with an appropriate protocol; a wireless transmitter e.g. in accordance with a Bluetooth® standard, a DECT standard, or a Wi-Fi standard. The transmitter may be combined with a receiver, receiving a signal from a far-end, e.g. to form an integrated transceiver.

The integrated circuit 106 is also configured with a first signal processor 107 and a voice activity detector 108. The first signal processor 107 and a voice activity detector 108 may be integrated e.g. in a programmable signal processor. The first processor 107 is coupled to receive the electric signal, x, from the microphone 119 to generate an output signal, y, to the transmitter 109 in response to a control signal, PDN, from the voice activity detector 108. Based on processing a portion of the electric signal, x, the voice activity detector 108 is configured to: detect proximal voice activity, distal voice activity and no voice activity, at times when respectively present in the acoustic signal picked up by the electro-acoustic transducer, and to select a respective mode, the selection of which is encoded in the control signal, PDN. The first processor 107 is controlled by the voice activity detector 108 to reduce, in the output signal, y, intelligibility of distal voice activity at least at portions of time periods when the control signal indicates the mode of presence of distal voice activity.

Figure 2:
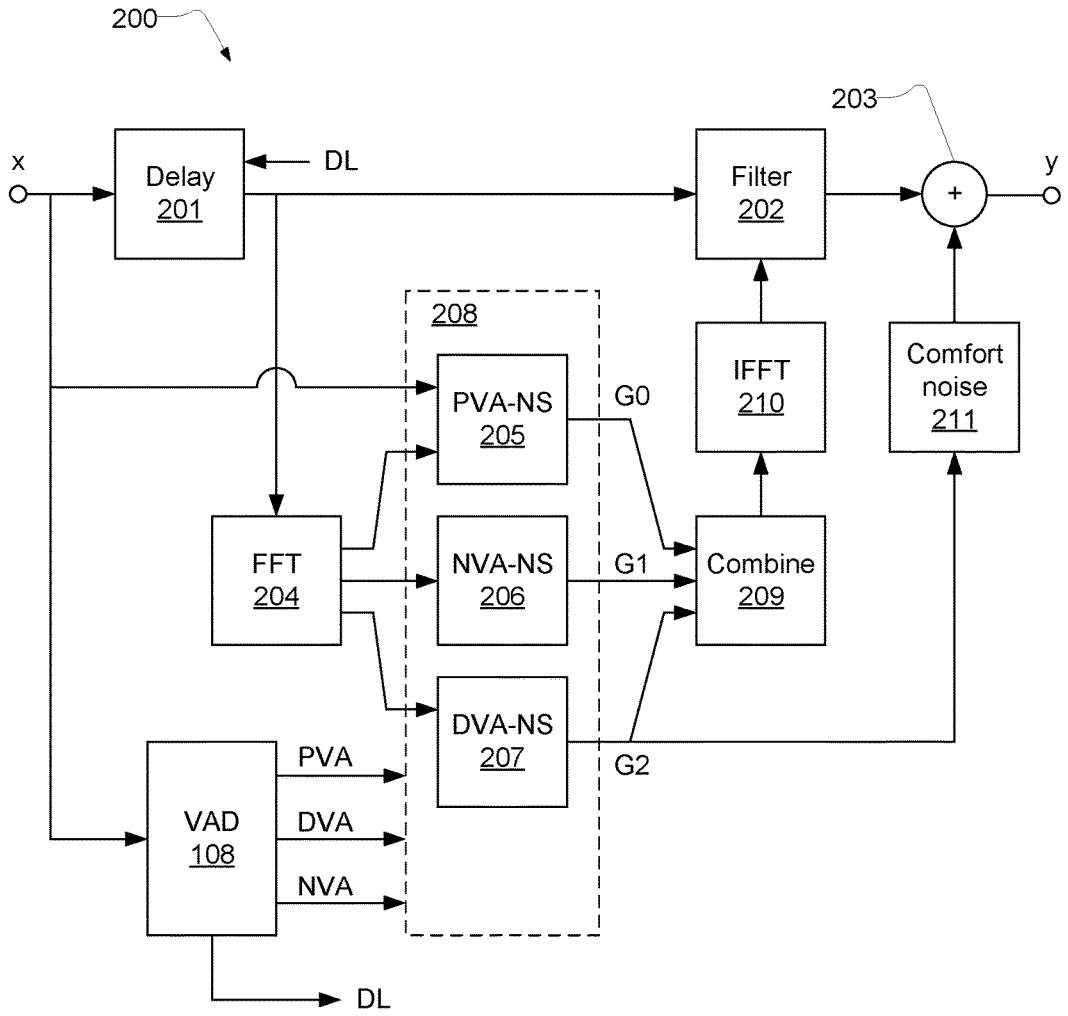
FIG. 2 shows a block diagram for a processor with a voice activity detector.

FIG. 2 shows a block diagram for a processor with a voice activity detector. The processor 200 comprises a delay 201 coupled to delay the electric signal, x, in digital form at a signal processing stage before a filter 202, which among other functions is controllable to reduce intelligibility of a speech signal as described above. The delay 201 is controllable via a delay control signal, DL, to delay the electric signal, x, by a first delay time or to forgo delay of the electric signal by the first delay time. The delay 201 may be implemented as a FIFO delay e.g. by a circular buffer.

The voice activity detector 108 is configured, as described above, to detect proximal voice activity, distal voice activity and no voice activity based on the electric signal before the electric signal is delayed by the delay 201. The voice activity detector 108 is configured to perform the detection instantaneously and to select a respective mode represented by respective control signals PVA; DVA; and NVA based on timing criteria so as to introduce some amount of dead-time preventing too fast transitioning in selection of modes and encoding in the control signal. Thereby the risk of introducing unpleasant distortion or artefacts in the output signal is reduced. The dead-time may by symmetrical between modes or asymmetrical.

As mentioned above, in connection with FIG. 1, the first processor 107 is controlled by the voice activity detector 108 to reduce, in the output signal, intelligibility of distal voice activity at least at portions of time periods when the control signal indicates the mode of presence of distal voice activity. In this embodiment the first processor comprises noise suppression gain computing units 205, 206, and 207, which are configured to respectively compute noise suppression gains for frequency bins for accordingly filtering the electric signal by means of a filter 202, such as a FIR filter, at times when the selected mode correspond to detection of 'proximal voice activity', 'distal voice activity' and 'no voice activity'. The noise suppression gain computing units 205, 206, and 207 receives the signal, x, in a time domain representation or in a frequency domain representation. The frequency domain representation may be provided a Fast Fourier Transform, FFT, unit 204.

The noise suppression gain computing units 205, 206, and 207 output respective noise suppression gains G0, G1 and G2 for each of multiple frequency bins (narrow band) or across multiple frequency bins (broad band). Thus, the noise suppression gains G0, G1 and G2 may be represented as scalar values or an array of values corresponding to the number of frequency bins. The noise suppression gain computing units 205, 206, and 207 computes and/or outputs the respective noise suppression gains in response to the respective control signals PVA; DVA; and NVA. For instance, in case the selected mode correspond to 'distant voice activity', the noise suppression gains output by noise suppression gain computing unit 207 may represent strong suppression (e.g. −40 dB), whereas in case the selected mode fails to correspond to 'distant voice activity', the noise suppression gains output by noise suppression gain computing unit 207 may represent no suppression (e.g. 0 dB).

A combining unit 209 receives the noise suppression gains G0, G1 and G2 and outputs, per frequency bin, the noise suppression gain from G0, G1 and G2 which has the strongest noise suppression (i.e. the lowest gain). This operation is based on the noise suppression gains being set to 0 dB when a respective mode is not selected. It should be noted that the noise suppression gain computing units 205, 206, and 207 and the combining unit 209 may be configured to suppress noise in accordance with a selected mode in other ways.

The combining unit 209 outputs an array of frequency bin specific noise suppression gains, which are input to an Inverse Fast Fourier Transform, IFFT, unit 210 which computes the inverse Fast Fourier Transform to provide the result thereof to the filter 202, which may be a FIR filter, filtering the electric signal, x, subject to be delayed or not delayed by the delay 201.

Comfort noise may be generated by a synthetic noise generating unit 211, whereby synthetic noise may be added to the electric signal as filtered by filter 202. The synthetic noise may be added by means of an adder 203 before providing the output signal, y.

Figure 3:
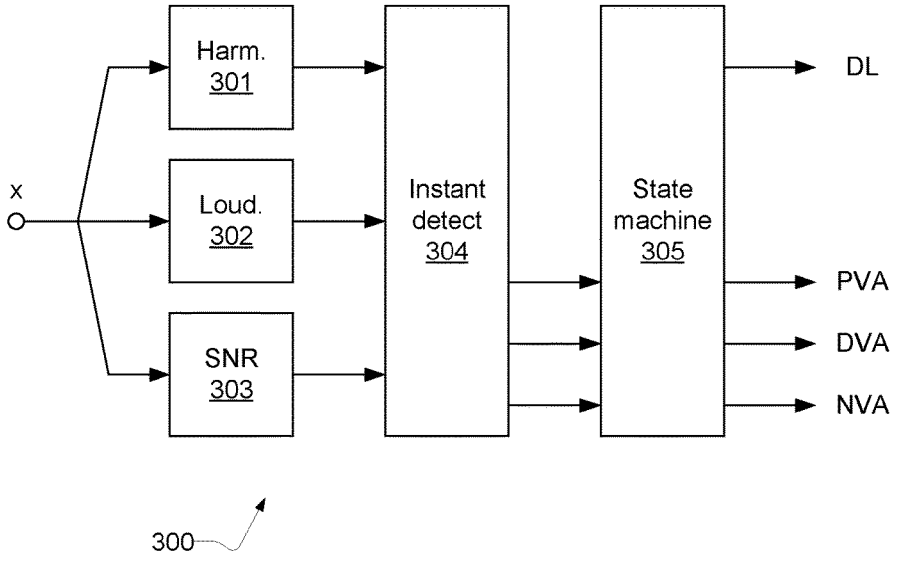
FIG. 3 shows a block diagram for a voice activity detector.

FIG. 3 shows a block diagram for a voice activity detector. In this embodiment the voice activity detector comprises a first unit 301 configured to receive the electric signal, x, to instantaneously detect a speech signal e.g. by means of the so-called Cepstrum method which is known in the art of speech processing, and to output a signal indicative of whether the detection was successful or not.

The voice activity detector also comprises a second unit 302 configured to receive the electric signal, x, to instantaneously detect whether the electric signal, x, has a loudness exceeding a threshold, and to output a signal indicative of whether the detection was successful or not.

The voice activity detector also comprises a third unit 303 configured to receive the electric signal, x, to instantaneously detect whether the electric signal, x, has a signal-to-noise ratio exceeding a threshold, and to output a signal indicative of whether the detection was successful or not.

The signals output by the first, second and third units 301, 302 and 303 are input to an instant detection unit 304, which determines which mode should be selected. A state machine 305 receives a signal from the instant detection unit 304 and outputs a control signal to the first processor wherein the selected state changes in response to detection of continued detection of distal voice activity over a first period of time of e.g. 1 to 5 seconds, e.g. 1 to 3 seconds and wherein the selected state changes in response to detection of continued failure to detect distal voice activity over a second period of time of e.g. about 5 to 20 seconds.

Figure 4:
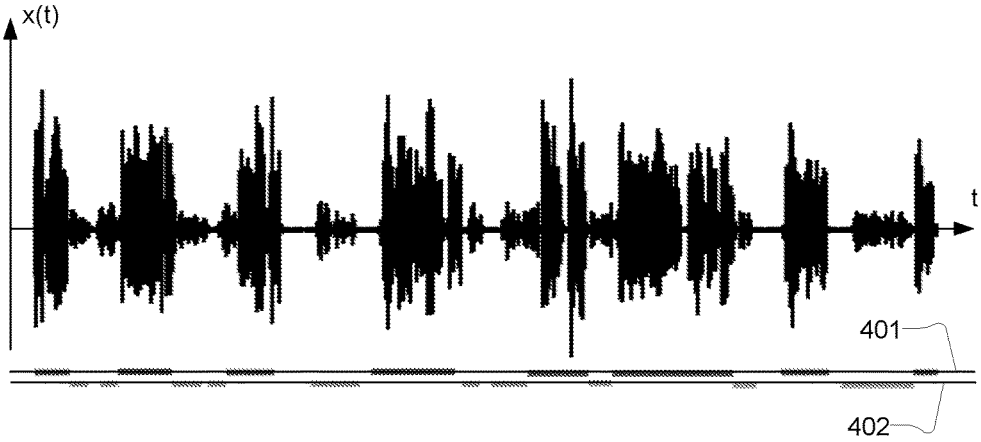
FIG. 4 illustrates a microphone signal.

FIG. 4 illustrates a microphone signal, x(t), as a function of time, t. Times when proximal speech is present are indicated by marks on the line 401. Times when distal speech is present are indicated by marks on the line 402. At times when there are no marks on the line 401 and no marks on the line 402, ambient noise not related to speech is more likely to be present.

Figure 5:
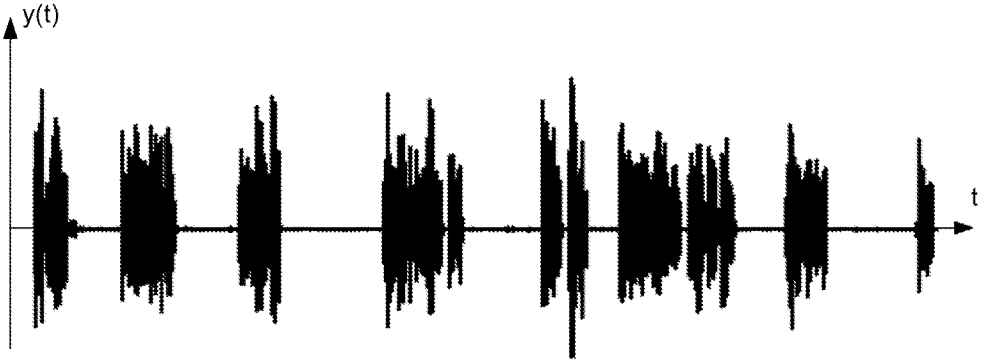
FIG. 5 illustrates a processed microphone signal.

FIG. 5 illustrates a processed microphone signal, y(t), as a function of time, t. FIG. 5 is geometrically aligned with FIG. 4 to represent the same point in time on a vertical line. Thus, it can be observed that signals which fails to cause detection of ambient noise not related to speech and which fails to cause detection of proximal voice activity is effectively suppressed.

In some embodiments the headset comprises a delay 201 coupled to delay the electric signal at a signal processing stage before the filtering to reduce intelligibility of distal voice activity; wherein the delay 201 is controllable via the delay control signal, DL, to delay the electric signal by a selectable delay time; wherein the voice activity detector, 108, is configured to detect proximal voice activity, distal voice activity and no voice activity based on the electric signal before the delay, 201; and wherein the voice activity detector 108 generates the delay control signal, DL, to delay the electric signal by the selectable delay time, which is determined by the voice activity detector 108.

In some embodiments the selectable delay time has a relative long duration at times when the selected mode indicates 'distal voice activity', and has a relatively short duration at times when the selected mode indicates a failure to detect 'distal voice activity'.

In some embodiments the voice activity detector 108 is configured to control the delay 201 and one or more of the noise suppression gain computing units 205, 206, and 207 to select:

a first selectable delay time which has a relative short duration and to select a first noise suppression which provides relative light noise suppression, such as less than 15 dB, e.g. about 10 dB, e.g. less than 10 dB, at times when the selected mode indicates a failure to detect 'distal voice activity'; and a second selectable delay time which has a relative long duration and to select a second noise suppression which provides relative strong noise suppression, such as more than 10 dB, e.g. 20 dB to 60 dB, e.g. about 50 dB, at times when the selected mode indicates 'distal voice activity'.

The first selectable delay time may be in the range of less than 10 seconds, e.g. less than 5 seconds, e.g. about 1 to 3 seconds. The second selectable delay time may be in the range of more than 10 seconds, e.g. in the range of more than 10 seconds to less than 30 seconds, e.g. about 20 seconds.

By failure to detect 'distal voice activity' may be understood, that a mode corresponding to 'no voice activity' or 'proximal voice activity' is selected.

In some embodiments there is provided: a headset 101 comprising: an electro-acoustic input transducer 119 arranged to pick up an acoustic signal and convert the acoustic signal to an electric signal, x; a transmitter 109; a voice activity detector 108; and a first processor 107 coupled to receive the electric signal, x, and to generate an output signal, y, to the transmitter 109 in response to a control signal, PDN, from the voice activity detector 108; wherein, based on processing a portion of the electric signal (x), the voice activity detector 108 is configured to: detect distal voice activity, which is different form proximal voice activity, and to select a mode indicative thereof, the selection of which is indicated in the control signal, PDN; wherein the first processor 107 is controlled by the voice activity detector 108 to reduce, in the output signal, intelligibility of distal voice activity at least at portions of time periods when the control signal, PDN, indicates the mode of presence of distal voice activity.

The invention claimed is:

1. A headset comprising:

an electro-acoustic input transducer arranged to pick up an acoustic signal and convert the acoustic signal to an electric signal (x);

a transmitter;

a voice activity detector;

a first processor coupled to receive the electric signal (x) and to generate an output signal (y) to the transmitter in response to a control signal (PDN) from the voice activity detector;

wherein, based on processing a portion of the electric signal (x), the voice activity detector is configured to: detect proximal voice activity, distal voice activity and no voice activity, at times when respectively present in the acoustic signal picked up by the electro-acoustic transducer, and to select a respective mode, the selection of which is indicated in the control signal (PDN);

wherein the first processor is controlled by the voice activity detector to reduce, by filtering, in the output signal, intelligibility of distal voice activity at least at portions of time periods when the control signal (PDN) indicates the mode of presence of distal voice activity;

a delay coupled to delay the electric signal at a signal processing stage before the filtering to reduce intelligibility of distal voice activity;

wherein the delay is controllable via a delay control signal (DL) to delay the electric signal by a first delay time or to forgo delay of the electric signal by the first delay time;

wherein the voice activity detector is configured to detect proximal voice activity, distal voice activity and no voice activity based on the electric signal before the delay; and wherein the voice activity detector generates the delay control signal (DL) to delay the electric signal by the first delay time at times when the control signal indicates selection of a mode corresponding to presence of distal voice activity, and to forgo delaying of the electric signal by the first delay time at times when the control signal (PDN) is indicative of failure to detect presence of proximal voice activity.

2. A headset according to claim 1, wherein the first processor is configured to reduce intelligibility of distal voice activity by performing one or more of: suppression, such as amplitude suppression, scrambling, and camouflaging of signal components in the electrical signal.

3. A headset according to claim 1, wherein the voice activity detector detects proximal voice activity based on a first criterion based on a detection of the electric signal (x) having a loudness and/or signal-to-noise ratio above a first threshold.

4. A headset according to claim 1, wherein the voice activity detector detects distal voice activity based on a second criterion based on a detection of the electric signal (x) having a loudness and/or signal-to-noise ratio failing to exceed a second threshold while having signal components qualifying the electric signal as comprising speech.

5. A headset according to claim 1, wherein the voice activity detector detects no voice activity, based on a third criterion, based on a detection of the portion of the electric signal (x) having a loudness and/or signal-to-noise ratio failing to exceed a third threshold.

6. A headset according to claim 1, wherein the first processor is configured with a noise reduction filter, which is operative to perform noise reduction at least at times when the control signal is indicative of a mode corresponding to presence of proximal voice activity.

7. A headset according to claim 1, wherein the first processor is configured with a first filter, which is a squelch filter or a noise reduction filter, which is operative to perform first signal suppression at least at times when the control signal (PDN) is indicative of no voice activity; and wherein the first processor is configured with a second filter, which is a squelch filter or a noise suppression filter, which is operative to perform second signal suppression at least at times when the control signal is indicative distal voice activity.

8. A headset according to claim 7, wherein the second signal suppression is significantly greater than the first signal suppression.

9. A headset according to claim 7, wherein the first signal processor is configured to perform the first signal suppression in the range between 6 dB and 18 dB and to perform the second signal suppression at more than 24 dB, such as at more than 30 dB, such as at more than 40 dB.

10. A headset according to claim 1, wherein the voice activity detector is configured to delay the electric signal by the first delay time in response to detection of continued detection of distal voice activity over a first period of time.

11. A headset according to claim 1, wherein the voice activity detector is configured to forgo delaying the electric signal by the first delay time in response to detection of continued failure to detect distal voice activity and/or in response to continued detection of proximal voice activity over a second period of time.

12. A headset according to claim 1, comprising a noise generator for adding digitally generated noise to the output signal.

13. A headset comprising:

an electro-acoustic input transducer arranged to pick up an acoustic signal and convert the acoustic signal to an electric signal (x);

a transmitter;

a voice activity detector; and a first processor coupled to receive the electric signal (x) and to generate an output signal (y) to the transmitter in response to a control signal (PDN) from the voice activity detector;

wherein, based on processing a portion of the electric signal (x), the voice activity detector is configured to: detect proximal voice activity, distal voice activity and no voice activity, at times when respectively present in the acoustic signal picked up by the electro-acoustic transducer, and to select a respective mode, the selection of which is indicated in the control signal (PDN);

wherein the first processor is controlled by the voice activity detector to reduce, in the output signal, intelligibility of distal voice activity at least at portions of time periods when the control signal (PDN) indicates the mode of presence of distal voice activity;

wherein the first processor is configured with a first filter, which is a squelch filter or a noise reduction filter, which is operative to perform first signal suppression at least at times when the control signal (PDN) is indicative of no voice activity; and wherein the first processor is configured with a second filter, which is a squelch filter or a noise suppression filter, which is operative to perform second signal suppression at least at times when the control signal is indicative of the presence of distal voice activity.

14. A headset according to claim 13, wherein the second signal suppression is greater than the first signal suppression.

15. A headset according to claim 13, wherein the first signal processor is configured to perform the first signal suppression in the range between 6 dB and 18 dB and to perform the second signal suppression at more than 24 dB.

16. A method used in a headset having an electro-acoustic input transducer arranged to pick up an acoustic signal and convert the acoustic signal to an electric signal (x), a first processor coupled to receive the electric signal (x) and to generate an output signal (y) to the transmitter in response to a control signal (PDN) from the voice activity detector, and a transmitter, the method comprising the steps of:

a. coupling the first processor to receive the electric signal (x) and generating an output signal (y) to the transmitter in response to a control signal (PDN) from the voice activity detector;

b. based on processing a portion of the electric signal (x), the voice activity detector detecting 1) proximal voice activity, 2) distal voice activity and 3) no voice activity, at times when respectively present in the acoustic signal picked up by the electro-acoustic transducer;

c. selecting a respective mode, the selection of which is controlled by the control signal (PDN);

d. filtering in response to the voice activity detector, intelligibility of distal voice activity in the output signal, at least at portions of time periods when the control signal (PDN) indicates the mode of presence of distal voice activity;

e. inserting a delay in the electric signal at a signal processing stage before the filtering to reduce intelligibility of distal voice activity;

f. wherein the delay is controllable via a delay control signal (DL) to delay the electric signal by a first delay time or to forgo delay of the electric signal by the first delay time;

g. configuring the voice activity detector to detect proximal voice activity, distal voice activity and no voice activity based on the electric signal before the delay; and h. generating the delay via the voice activity detector to delay the electric signal by the first delay time at times when the control signal indicates selection of a mode corresponding to presence of distal voice activity, and to forgo delaying of the electric signal by the first delay time at times when the control signal (PDN) is indicative of failure to detect presence of proximal voice activity.

* * * * *